United States Patent [19]

Luksus

[11] 4,134,448

[45] Jan. 16, 1979

[54] HEATING AND AIR CONDITIONING SYSTEM

[76] Inventor: Edmund Luksus, 2491 Ranburn, Gary, Ind. 46408

[21] Appl. No.: 791,238

[22] Filed: Apr. 27, 1977

[51] Int. Cl.[2] ..... F25B 29/00; F24D 9/00

[52] U.S. Cl. ..... 165/62; 237/19

[58] Field of Search ..... 237/19; 126/101; 165/62

[56] References Cited

U.S. PATENT DOCUMENTS

| | | | |
|---|---|---|---|
| 1,808,761 | 6/1931 | Brand | 126/101 |
| 2,813,683 | 11/1957 | Dillman | 237/19 X |
| 3,198,190 | 8/1965 | Gordon | 126/101 |

FOREIGN PATENT DOCUMENTS

| | | | |
|---|---|---|---|
| 448244 | 5/1948 | Canada | 126/101 |

*Primary Examiner*—Carlton R. Croyle

*Assistant Examiner*—Leonard E. Smith

*Attorney, Agent, or Firm*—Walter Leuca

[57] ABSTRACT

This invention combines a hot water heater which conventionally supplies hot water for household use, a hot air furnace and an air conditioning evaporator coil conventionally provided in the plenum of the furnace as a component of a central air conditioning system, by means of pipes from the hot water heater to the air conditioning evaporator coil. Hot water heated by the hot water heater circulates through the evaporator coil which becomes the heat source for the air moving through the furnace and ductwork throughout the house. Valve means are provided in the water pipe lines to isolate the hot water heater from the air conditioning evaporator coil when the coil is used as a component of the air conditioning system during the summer months. Valve means are provided in the air conditioning lines to isolate the coil from the air conditioning compressor and condensor unit during the winter months.

8 Claims, 3 Drawing Figures

HEATING AND AIR CONDITIONING SYSTEM

BACKGROUND OF THE INVENTION

1. Field of the Invention

This invention relates generally to domestic heating plants and more particularly to a novel combination of heat transfer units to heat a home.

2. Description of the Prior Art

Conventional heating units for homes generally include a hot water heater and a furnace. A central air conditioning evaporator coil is usually included in the plenum of the furnace for air conditioning purposes during the summer. The hot water heater provides hot water for the usual household needs. The BTU capacity of the furnace is substantially greater than the BTU capacity of the hot water heater. To operate either of the units at lower than their design capacity will result in inefficiency and fuel waste.

SUMMARY OF THE INVENTION

I accomplish the conservation of fuel used for domestic heating by interchanging the heated medium from one unit to the other unit at appropriate times either to heat the water for domestic use or to heat the air circulating through the furnace. During the months requiring heat, I disconnect the air conditioning evaporator coil from the compressor and condensor unit and drain the coil of refridgerant. Accordingly, means are provided including valves to disconnect the coil from the rest of the air conditioning system. I further connect conduits or pipes between the hot water heater and the evaporator coil for circulating therethrough water from the hot water heater. The water transfer pipes are provided with valve means so that during the summer months when the air conditioning evaporator coil is in use as an air conditioning component, the valves are closed to isolate the water line from the coil and allow for the introduction of refridgerant into the coil. A heating furnace of high BTU rating operates at maximum efficiency at its rated capacity. When the furnace of high BTU capacity is in operation during milder weather when it is operating well below its BTU rating, the efficiency of operation is very low and fuel is wasted. Accordingly, I provide a novel combination of heat exchange units so that when the winter weather is less severe or when the house is well insulated so that the heating furnace is not required to operate at its rated capacity, I bypass hot water from the hot water heater through the air conditioning evaporator coil mounted in the plenum of the furnace to provide the heat to the furnace. The air blower fan of the furnace is made to operate to circulate the air through the furnace to be heated by the hot water passing through the air conditioning evaporator coil. I also provide auxiliary hot flue pipes extending from the hot water main flue pipe for bypass through the main plenum to which are connected the air ducts for distributing air throughout the house. Dampers are provided so that these auxiliary flue pipes may be closed during the summer months when the air conditioning unit is in operation. Accordingly, by combining the operation of the hot water heater and the hot air furnace through the structure of the air conditioning evaporator coil, a substantial amount of fuel will be saved by utilizing the hot water heater operating at full capacity and therefore at its optimum efficiency when it is not required to operate the heating furnace at its full BTU capacity to heat a house. Conversly, when it is required, due to the nature of the weather, to operate the heating furnace at its full capacity and therefore its optimum efficiency, the water circulating through the air conditioning evaporator coil will be returned to the hot water heater, heated by the operation of the furnace so that the hot water heater will not be required to operate to heat the water. The novel combination of my invention will save fuel by transferring heat energy from one unit to the other while operating at a high rate of efficiency.

Other objects and advantages of my invention will become more apparent after a careful study of the following detailed description taken together with the accompanying drawings which describe and illustrate a preferred embodiment of my invention.

DESCRIPTION OF THE PREFERRED EMBODIMENT

Figure 1:
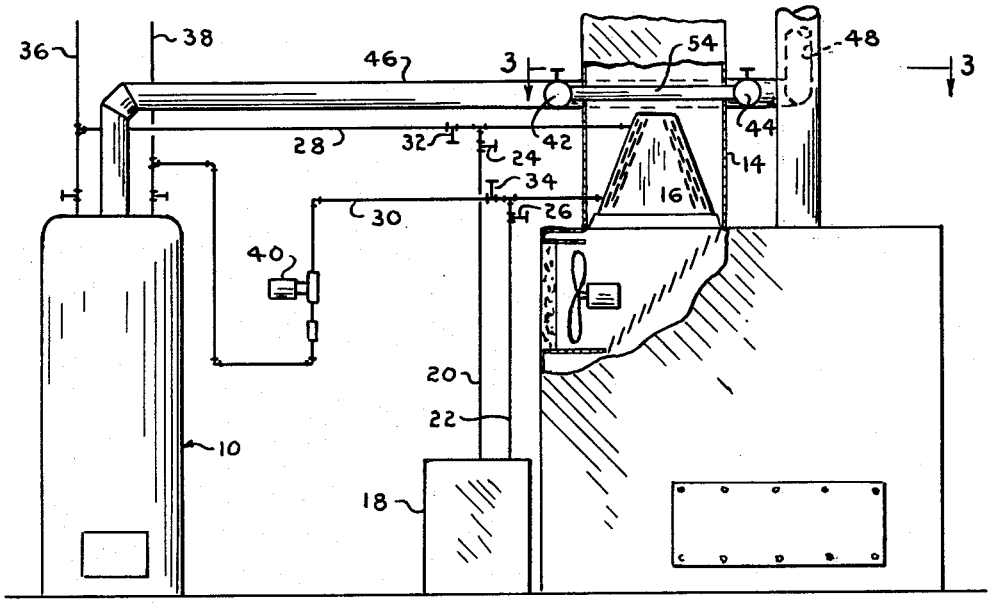
FIG. 1 is a side elevation showing the combination of the hot water heater, hot air furnace and the central air conditioning system, with part of the furnace and main plenum broken away.

Referring now more particularly to the drawings, and in particular to the embodiment of FIG. 1, numerals 10 and 12 designate generally the hot water heater and the hot air furnace respectively, of my invention. Provided in the main plenum 14 of furnace 12 is air conditioning evaporator coil 16 which is connected to the compressor and condensor unit 18 by means of conduits 20 and 22. This unit 18 is generally located exterior of the house. Also provided are valves 24 and 26 in conduits 20 and 22 respectively, for isolating evaporator coil 16 from compressor unit 18. Connected to evaporator coil 16 are water conduits 28 and 30 which serve as delivery and return pipes for the hot water. For convenience I show pipes 28 and 30 diagramatically, connected to pipes 20 and 22, also shown diagramatically, by means of valves 32 and 34 respectively. Water pipes 28 and 30 are connected to the conventional water lines 36 and 38 of hot water heater 10. Valves 32 and 34 are shut to isolate coil 16 from water lines 28 and 30 and allow the coil to be a component part of the air conditioning system during the summer months. In one water line 30, I provide water booster pump 40 to circulate the water between coil 16 and hot water heater 10.

As a supplemental heat transfer means, I provide take-off pipes 42 and 44 communicating with hot water flue pipe 46 which terminates at its distal end 48 into the chimney of the building (not shown).

Figure 3:
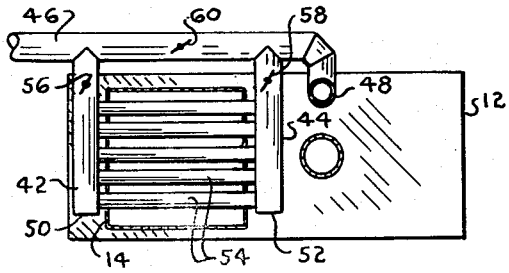
FIG. 3 is a top view of the auxiliary flue pipe branching from the hot water heater main flue pipe taken along lines 3—3 of FIG. 1.

As more clearly shown in FIG. 3, auxiliary flue pipe 42 branches from main flue pipe 46 extending alongside main plenum 14 above evaporator coil 16. Return flue pipe 44 is connected to hot water heater flue pipe 46 along the opposite side of main plenum 14. The distal ends 50 and 52 of take-off pipes 42 and 44 respectively, are closed and a plurality of holes are provided spaced along the length of pipes 42 and 44 to which are connected a plurality of tubes 54 to communicate pipes 42 and 44. Dampers 56 and 58 are provided in pipes 42 and 44, respectively, as well as damper 60 provided in main flue pipe 46 so that the hot flue gases generated by the burner of the hot water heater 10 will bypass through auxiliary pipes 42, 54 and 44 by closing damper 60 in main flue pipe 46 and opening dampers 56 and 58 in take-off pipe 42 and return pipe 44. The hot flue gases bypassing through pipes 54 will provide additional heat in main plenum 14 of hot air furnace 12 which will supplement the heat provided by the hot water circulating through evaporator coil 16.

Figure 2:
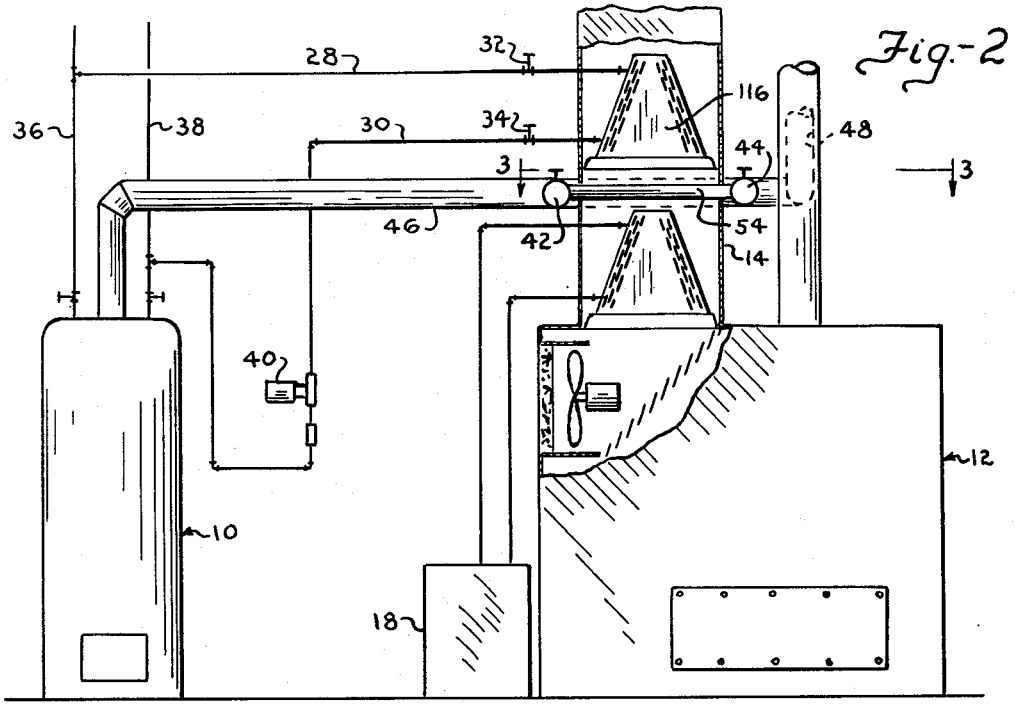
FIG. 2 is a side elevation of the hot water heater, hot air furnace and a coil component from a central air conditioning system separate and apart from the air conditioning system provided with the furnace.

FIG. 2 is an embodiment of my invention wherein is shown an added air conditioning evaporator coil 116 which is not connected to the central air conditioning system. It may be provided if plenun 14 of furnace 12 is sufficiently extensive to accomodate the added coil 116 and it is preferred not to break the integrity of the air conditioning system each fall and summer. A separate coil 116 may be provided apart from an air conditioning system in installations which do not have a central air conditioning system incorporated into the ductwork of a hot air furnace. The combination of FIG. 2 will accomplish the same result as the combination of FIG. 1 and will not require valving to isolate the evaporator coil from the air conditioning unit 18 during the months required for heating. The advantage of this combination is that once the installation is made it will not be necessary to disturb the air conditioning system with every heating and cooling season.

In the operation of my invention illustrated in FIG. 1, valves 24 and 26 in refridgerant lines 20 and 22, respectively, are closed and evaporator coil 16 is bled to remove the refridgerant therefrom. The coil is flushed out in any convenient manner and dried which is normally done by removing the tubing or pipes from the coil and reconnecting them after the flushing and drying operation. Valves 32 and 34 in water lines 28 and 30 are opened so that water from the hot water heater may be circulated through evaporator coil 16. Though the practice of this invention contemplates flushing of the coil of refrigerant fluid prior to the introduction of the hot water therethrough, and keeping the circulation systems of the refrigerant fluid and hot water isolated from each other by valving means, nontoxic refrigerant fluid, many of which are commercially available, may be used for the practice of this invention as an additional precaution. Hot water heater 10, hot air furnace 12 and evaporator coil 16 of the central air conditioning system are combined so that hot water from hot water heater 10 is circulated through evaporator coil 16 to provide sufficient heat in the path of the air flow through furnace 12 to heat the air for distribution through the ductwork of the house. Also hot flue gases from the hot water heater burner which is otherwise wasted up the chimney is bypassed by means of pipes 42, 54 and 44 through main plenum 14 to provide additional heat in the main plenum of the furnace ductwork. I have found that under normal winter conditions in the temperate zone in the United States, the heating system of my invention provides sufficient heat to heat a house without the operation of the burners of furnace 12 resulting in greatly reduced fuel usage. Under abnormal cold conditions when it is required that the heating furnace be put into use, it can then operate at its rated capacity and therefore at its maximum efficiency. The heat generated by the furnace may then heat the water circulating through evaporator coil 16 by means of pump 40 and returned to the hot water heater in heated condition. At such times, hot water heater 10 will not operate resulting in conserving a substantial amount of fuel.

The operation of the embodiment of my invention shown in FIG. 2 is the same as described for the embodiment shown in FIG. 1 with the exception that the evaporator coil of the air conditioning system 18 is not disturbed. Also, the embodiment of FIG. 2 does not require an air conditioning system to provide the evaporator coil component. Corresponding parts of my invention illustrated in FIG. 2 with those of the embodiment shown in FIG. 1 are designated by like numerals.

I claim:

1. A heating system for a building comprising the combination of:

a water heater having conduit means for delivering water to said water heater, and conduit means for delivering heated water from said water heater;

a hot air furnace having a plenum and air duct means communicating with said plenum;

an air conditioning apparatus having an evaporator coil device in said plenum of said furnace, and compressor and condensor units removed from said coil, said compressor and condensor units being connected to said coil by delivery and return conduit means for circulating refrigerant fluid;

connecting conduit means communicating said conduit means for delivering water to said water heater and said evaporator coil device in said plenum, and a second connecting conduit means communicating said conduit means for delivering heated water from said water heater and said evaporator coil device; and valve means in said first and second connecting conduit means operable to exclude water from said coil, and valve means in said delivery and return conduit means for circulating refrigerant fluid operable to exclude refrigerant fluid from said coil.

2. A heating apparatus for a building comprising:

a water heater having conduit means for delivering water to said water heater, and conduit means for delivering heated water from said water heater;

a hot air furnace having a plenum and air duct means communicating with said plenum;

an air conditioning apparatus having an evaporator coil device in said plenum of said furnace, and compressor and condensor units removed from said coil, said compressor and condensor units being connected to said coil by delivery and return conduit means for circulating refrigerant fluid therebetween;

connecting conduit means communicating said conduit means for delivering water to said water heater and said evaporator coil device in said plenum, and a second connecting conduit means communicating said conduit means for delivering heated water from said water heater and said evaporator coil device; and valve means in said first and second connecting conduit means for isolating said water heater from said coil, and valve means in said delivery and return conduit means for circulating refrigerant fluid to isolate said coil from said compressor and condensor units.

3. The heating apparatus of claim 2 wherein said second connecting conduit means is characterized as having pump means for circulating water through said evaporator coil and said water heater.

4. The heating apparatus of claim 2 wherein said coil is provided with a fitting for evacuating said refrigerant fluid therefrom.

5. A heating system for a building comprising the combination of:

a water heater having conduit means for delivering water to said water heater, and conduit means for delivering heated water from said water heater;

a hot air furnace having a plenum and air duct means communicating with said plenum;

an air conditioning apparatus having an evaporator coil device in said plenum of said furnace, and compressor and condensor units removed from said coil, said compressor and condensor units being connected to said coil by delivery and return conduit means for circulating refrigerant fluid;

connecting conduit means communicating said conduit means for delivering water to said water heater and said evaporator coil device in said plenum, and a second connecting conduit means communicating said conduit means for delivering heated water from said water heater and said evaporator coil device;

valve means in said first and second connecting conduit means for isolating said water heater from said coil, and valve means in said delivery and return conduit means for circulating refrigerant fluid to isolate said coil from said compressor and condensor units; and fitting means communicating with said coil device for evacuating said refrigerant fluid from said coil device.

6. The combination of claim 5 wherein said second connecting conduit means is characterized as having pump means for circulating water through said evaporator coil and said water heater.

7. A heating system for a building comprising the combination of:

a fuel fired water heater having conduit means for delivering water to said water heater, conduit means for delivering heated water from said water heater, and flue pipe means for evacuating gases of combustion;

a hot air furnace having a plenum and air duct means communicating with said plenum;

an air conditioning apparatus having an evaporator coil device in said plenum of said furnace, and compressor and condensor units removed from said coil, said compressor and condensor units being connected to said coil by delivery and return conduit means for circulating refrigerant fluid;

connecting conduit means communicating said conduit means for delivering water to said water heater and said evaporator coil device in said plenum, and a second connecting conduit means communicating said conduit means for delivering heated water from said water heater and said evaporator coil device;

valve means in said first and second connecting conduit means for isolating said water heater from said coil, and valve means in said delivery and return conduit means for circulating refrigerant fluid to isolate said coil from said compressor and condensor units;

fitting means communicating with said coil device for evacuating said refrigerant fluid from said coil device; and a second flue pipe means communicating with said first mentioned flue pipe means, said second flue pipe means passing through said plenum of said hot air furnace.

8. The combination of claim 7 wherein said second connecting conduit means is characterized as having pump means for circulating water through said evaporator coil and said water heater.

* * * * *